United States Patent [19]

Perolls et al.

[11] 4,370,845

[45] Feb. 1, 1983

[54] METHODS OF AND APPARATUS FOR CLOSING BAG MOUTHS

[76] Inventors: Roland F. Perolls, The Entrance Lodge, Sandy Warren, Sandy, Bedfordshire; Norman R. Steel, 56 Norton Rd., Letchworth, Hertfordshire, both of England

[21] Appl. No.: 177,939

[22] Filed: Aug. 14, 1980

[30] Foreign Application Priority Data

Aug. 15, 1979 [GB] United Kingdom ..... 7928361

[51] Int. Cl.[3] ..... B65B 1/06; B65B 43/30; B65B 7/06; B65B 51/14

[52] U.S. Cl. ..... 53/572; 53/573; 53/373

[58] Field of Search ..... 53/572, 373, 469, 479, 53/371, 570, 573; 229/62

[56] References Cited

U.S. PATENT DOCUMENTS

| | | | |
|---|---|---|---|
| 2,626,495 | 1/1953 | Gaubert | 53/379 |
| 3,019,583 | 2/1962 | Sylvester et al. | 53/373 |
| 3,529,400 | 9/1970 | Takagaki | 53/373 X |
| 3,566,578 | 3/1971 | Thorne et al. | 53/573 X |
| 3,766,710 | 10/1973 | Goodwin et al. | 53/373 |
| 3,805,489 | 4/1974 | Lieder et al. | 53/378 |
| 3,889,449 | 6/1975 | Membrino | 53/373 X |
| 3,981,121 | 9/1976 | Turunen et al. | 53/379 X |
| 4,070,853 | 1/1978 | Sanders | 53/379 X |
| 4,078,358 | 3/1978 | Henderson | 53/469 X |
| 4,124,966 | 11/1978 | Wilson | 53/469 X |
| 4,177,621 | 12/1979 | Powell, Jr. | 53/469 X |
| 4,214,417 | 7/1980 | Lieder | 53/371 |

FOREIGN PATENT DOCUMENTS

| | | | |
|---|---|---|---|
| 1455570 | 11/1976 | United Kingdom | 229/62 |

*Primary Examiner*—Horace M. Culver

*Attorney, Agent, or Firm*—Roylance, Abrams, Berdo & Farley

[57] ABSTRACT

The disclosure relates to methods and apparatus for closing a bag mouth of a bag formed from a heat weldable material after filling the bag through the open mouth thereof. The bag mouth is supported from within the mouth by flat elements held apart across the mouth to draw the mouth into an elongate form and then the sides of the mouth are pressed together between an elongate heating element and an elongate anvil and the heating element is activated to heat weld the sides of the mouth together to close the mouth.

11 Claims, 7 Drawing Figures

METHODS OF AND APPARATUS FOR CLOSING BAG MOUTHS

BACKGROUND OF THE INVENTION

1. Field of the Invention

This invention relates to methods and apparatus for closing of bag mouths and is particularly although not exclusively applicable to closure of bags for irregular size produce such as potatoes and the like.

2. Description of the Prior Art

The supply of produce and materials in plastic bags or sachets which are closed by heat sealing or separate tape or wire closures have become commonplace. One method known as "form filling" comprises forming a tube of plastic material containing the relevant produce and heat sealing the tube at spaced intervals along the tube and severing the tube within the width of each heat seal to produce individual sachets or bags. This system is primarily used for forming sachets to contain liquids and by severing the tube at equally spaced locations along the tube, sachets containing substantially the same volumes of liquid are formed. The system is not however suitable for forming sachets or bags of material containing equal weights of discrete elements or particles such as arises in the case of supply fresh produce e.g. potatoes and the like. Conventionally bags for fresh produce and the like are individually filled with the appropriate weight of produce and the open mouth of the bag is individually closed. Such closure is normally by means of adhesive tape or wire tether although attempts have been made to heat seal the open ends of such bags. These attempts have met with little success because of the difficulty of supporting the mouth of the bag containing a considerable weight of produce whilst performing the heat seal.

The object of this invention is to provide a method and apparatus for closing the mouth of a heat sealable bag containing a weight of produce.

SUMMARY OF THE INVENTION

The invention provides a method of closing a bag mouth of a bag formed from a heat weldable material after filling the bag through the open mouth thereof comprising the steps of: supporting the bag mouth from within the mouth and applying tension across the mouth to draw the mouth into an elongate form, pressing the sides of the mouth together along a line extending lengthwise of the mouth and heating the bag material along said line to weld the material of the bag mouth on either side of the mouth along said line together to close the mouth.

The invention also provides a bag closure apparatus comprising means for releasably supporting a bag with its mouth open for filling, an elongate heating element, an elongate anvil, a pair of substantially flat tensioning elements insertable into the bag through the open mouth thereof, means for separating the elements such that the outer edges of the elements engage the bag under tension to hold the bag mouth closed flat after said support means have released the bag, and means for moving at least one of the heating element and anvil to compress and heat seal the sides of the mouth of the bag together.

DESCRIPTION OF THE PREFERRED EMBODIMENTS

Figure 1:
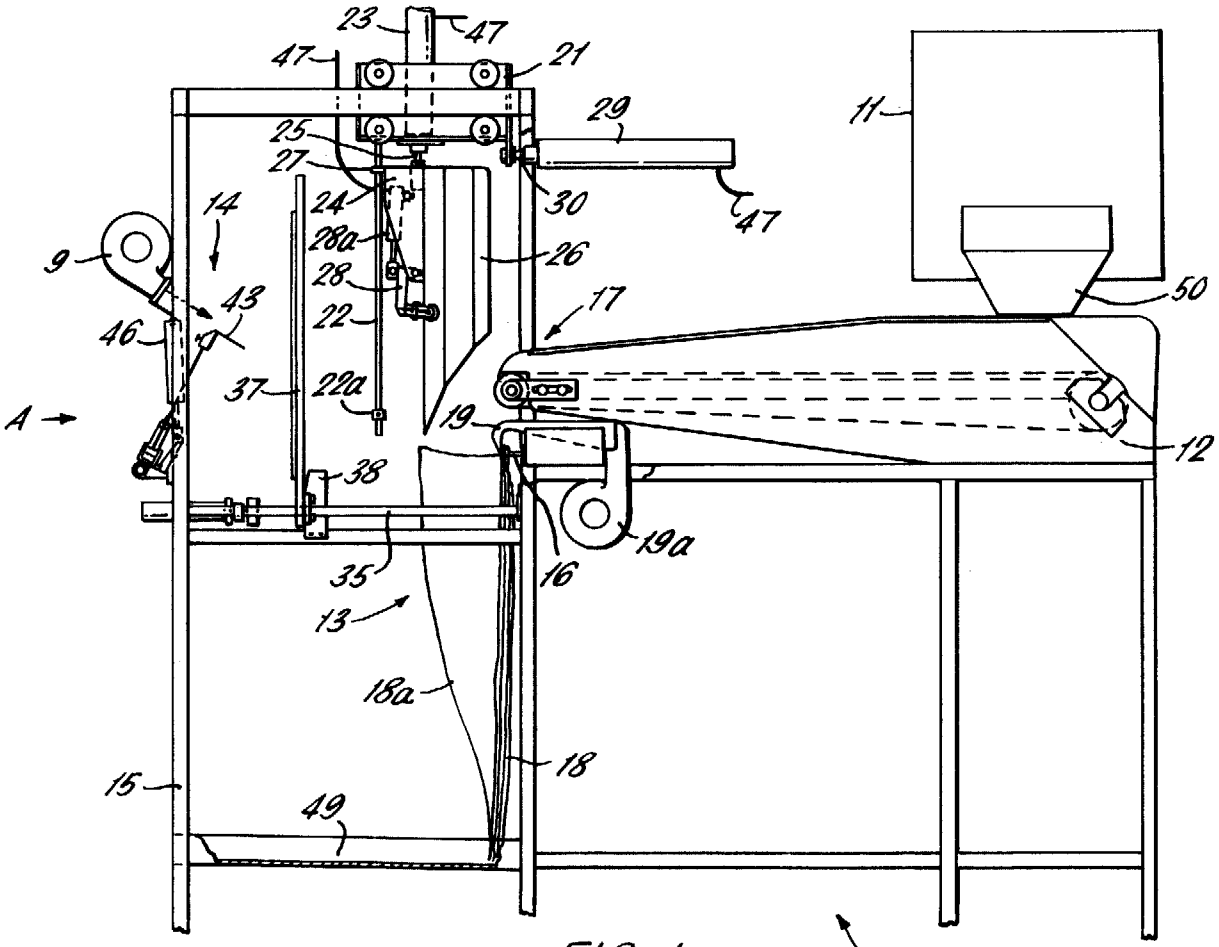
FIG. 1 is a side view of a weighing, bagging and sealing apparatus.

FIG. 1 shows an apparatus for weighing discrete weights of produce such as potatoes, for filling a bag with a discrete weight and for sealing the bag. This apparatus, 10, comprises a weighing machine, schematically shown at 11, a streaming conveyor 12, a bag filling station, generally indicated at 13, and a bag closing station, generally indicated at 14.

The weighing machine 11 is disposed on the far right of the apparatus and the conveyor 12 extends right to left to the bag filling station 13. The bag closing station 14 is on the left hand side of the bag filling station 13 and is aligned therewith.

The bag filling station 13 and bag closing station 14 will now be described in detail. As will be seen from the description below some parts of the bag filling station 13 are also utilised in the bag closing station 14. Both stations are mounted in an upright rectangular frame 15.

The bag filling station 13 includes a wicketed bag holder 16 which is mounted immediately beneath the left hand or output end 17 of the conveyor 12. The bags 18 are formed from a heat weldable plastics and each have an upstanding flap on one side of the bag mouth by which they are attached to the wicket with their mouths uppermost. The wicketed bag holder is arranged to hold a supply of bags 18, so that they extend vertically downwards from the holder.

Mounted immediately above the wicketed bag holder 16 but below the output end 17 of the conveyor 12 is an elongate nozzle 19 extended parallel to the output end of the conveyor pump **19*a*, the nozzle 19 being disposed and shaped to blow down into and thereby open the left hand most bag 18*a* on the wicket of bags 18 as shown in FIG. 1**.

Figure 2:
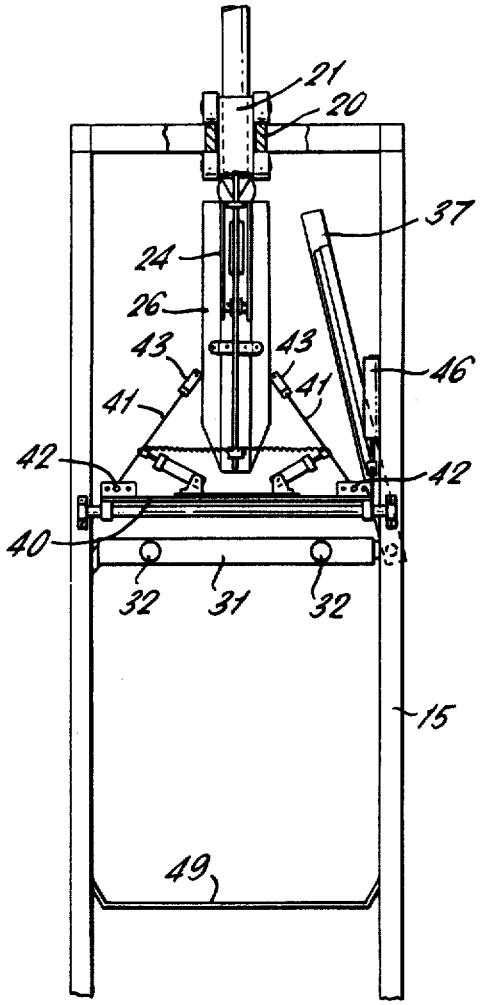
FIG. 2 is an end view on the arrow A in FIG. 1 with the weighing apparatus and a part of the bagging apparatus remitted.

A guideway 20 is mounted in the top of the frame 15 and extends centrally along the top of frame 15 as best seen in FIG. 2. Mounted on the guideway is a freely running wheel trolley 21. The trolley 21 supports a vertically downwardly extending rigid guide post 22 and also a vertically acting pneumatic ram 23. A channel 24 is mounted on the downwardly extending piston 25 of the pneumatic ram 23. An elongate open sided chute 26, of generally semi-hexagonal cross-section, is mounted on the back of the channel 24 to extend downwardly parallel to the axis of the piston 25. The open side of the chute faces towards the conveyor 12. A bearing 27 mounted on the channel 24 is slidably engaged on guide post 22 to guide the channel up and down the post. The chute 26 is tapered at its lower end such that its lower most point is formed by the side which is furthest away from the output end 17 of conveyor 12.

A pneumatically operable pivotable clamp 28 is mounted in the channel 24 to clamp against three adjacent faces of the outer side of the chute 26. The clamp 28 is operated by a ram 28*a* which is energised to close the clamp 28 against the chute by a striker 22*a* on the lower end of guide post 22 engaging a valve moving with the ram 28*a* to clamp the side of a bag extending around the chute to the chute.

A horizontally extending pneumatic ram 29 is mounted at the upper end of frame 15, and has a piston rod 30 attached to the trolley 21 to traverse the trolley and with it the chute 26 along the top of the frame 15 from the bag filling station to the bag closing station.

The bag closing station will now be described, principally with reference to FIGS. 2 and 3. The bag closing station 14 is essentially a heat sealing station and has a horizontally orientated heating element 31 extending widthwise of the frame and is mounted on a pair of spaced horizontally acting pneumatic rams 32 for movement lengthwise in the frame 15. The heat sealing element 31 is connected to a power source (not shown) by lead 31*a*. The operative surface of heating element 31 faces the output end 17 of conveyor 12. The rams 32 are supported on the frame 15 on a bar 33 mounted at one end on a longitudinal frame member 34 and having a similar mounting (not shown) at the other end of the bar. In an alternative construction the rams 32 may be rigidly mounted directly on the frame 15 and the heating element may be carried by a pair of vertical swinging links pivotally mounted in the frame.

A shaft 35 extends horizontally lengthwise of the frame to one side of the frame and is rotatably mounted in bearings (not shown) in the frame. A pneumatic ram 36 is supported on frame 15, by means not shown and is mechanically coupled to a rod 35 for rotating the rod 35. An anvil 37, for co-operating with heating element 31 is rigidly mounted at one end on rod 35. In one rotational position of the rod 35, the anvil 37 extends generally vertically, as shown in FIGS. 1 and 2, whilst in another rotational position of rod 35, see FIG. 3, the anvil extends across the width of frame 15, so that its free end rests on the frame member 34. In this position the anvil extends parallel to the heating element 31 and is held against movement away from the heating element 31 by a stop 38, which is mounted on the frame member 34. A rod 39 is pivotably mounted at one end of the frame 15 and extends across the frame above and behind the level of heating element 31. A platform 40 is fixedly mounted on the rod 39 and extends along the central portion thereof. The platform 40 carries a pair of outwardly extending spaced arms 41, which have pivotal mountings 42 on the platform for rotation of the arms about axes extending generally transverse to the rod 39.

Each arm 41 has a flat finger element 43 at its free end extending at right angles to the respective arm. The remote edges of the two finger elements 43 are cut away adjacent their free ends as indicated at 43*a*. Also mounted on the platform 40, between the arms 41, are a pair of oppositely facing pneumatic rams 44, the piston rods 45 of which are attached to the respective arm 41, such that rams 44 can be used to swing the arms 41 apart. A spring 41*a* is connected between the arms 41, adjacent the connections of the pistons 45 and acts in a sense to draw the arms 41 together, so that when the pneumatic rams 44 are not activated the arms 41 incline towards each other and lie at approximately 45° to the rod 39 when the rams 44 are fully retracted. In a further construction the arms may be cross-connected to ensure that the arms move synchronously and that the movement of one arm is "mirrored" by the movement of the other arm.

A pneumatic ram 46 is mounted on the frame 15 and has its piston connected to platform 40 such that operation of the ram 46 rotates the rod 39 in a sense to drive the finger elements 43 down between the heating element 31 and the horizontal position of angle 37.

Each of the pneumatic rams mentioned above is connected by means of an air line, each of which is indicated 47, to a pneumatic control system, diagrammatically shown at 48. The pneumatic control system 48 is connected to a source of compressed air by line 48*a*. The connection of lines 47 to the system 48 are shown in FIG. 3 for most of the pneumatic rams, but for those rams which are only shown in FIG. 1 the connections are not shown. It will be appreciated that the connections are of a standard type. It will further be appreciated that the system 48 can either be a unitary control as illustrated in FIG. 3 or may be constituted by a number of valves distributed about the apparatus. A table 49 extends across the cross-section of frame 15 beneath element 34 and rod 35 to support the lower edges of bags 18. The table is slightly upwardly inclined from right to left in FIG. 1, because as the bags become filled their vertical dimension decreases.

Referring to the weighing machine 11, this machine is shown diagrammatically and can be any weighing machine certified by the Weights and Measures Authorities for providing discrete weight batches of potatoes, or whatever particulate material is to be bagged. Each batch when weighed is dispensed by means of hopper 50 onto conveyor 12.

Figure 4:
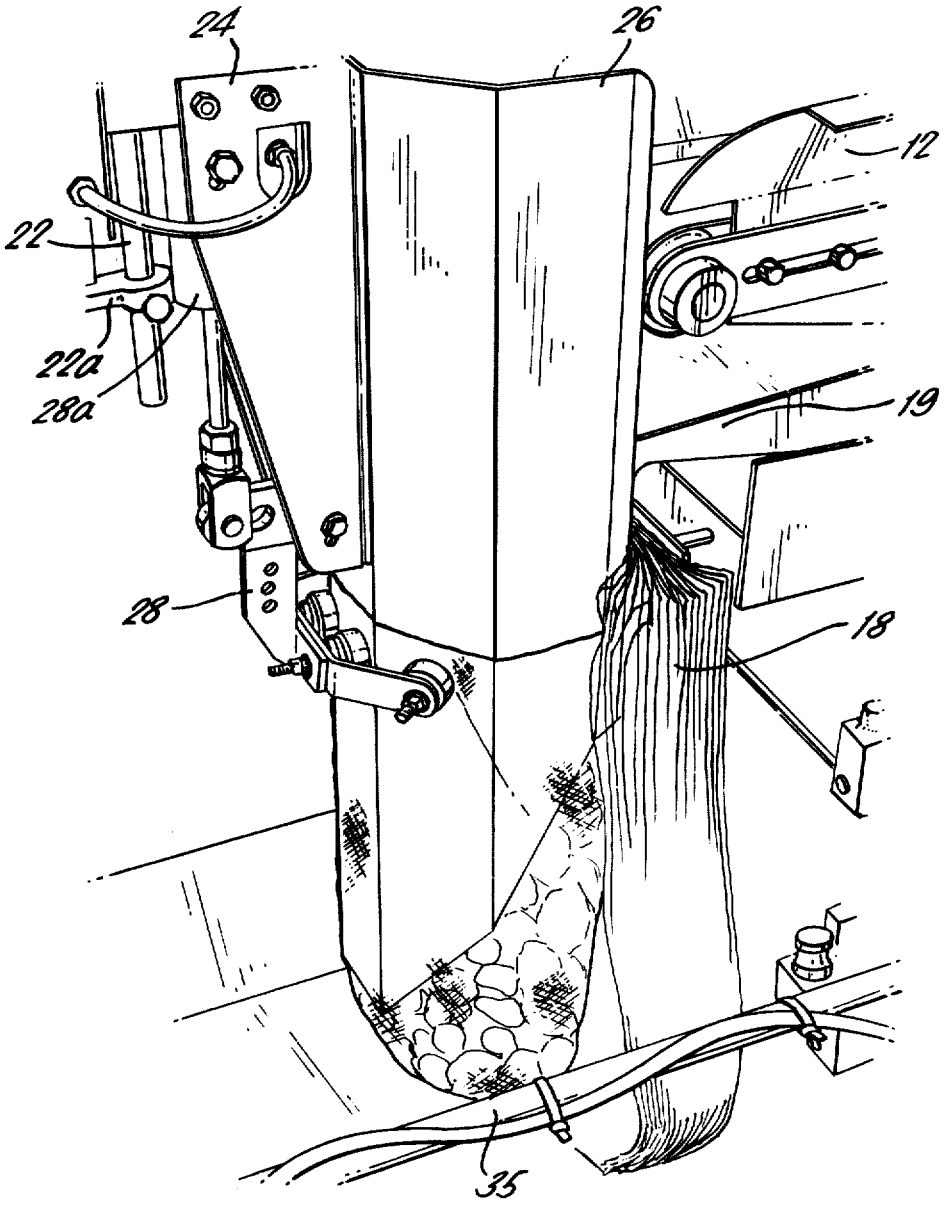
FIG. 4 is a view of a part of FIG. 1 showing the filling operation of the apparatus in FIG. 1.
Figure 5:
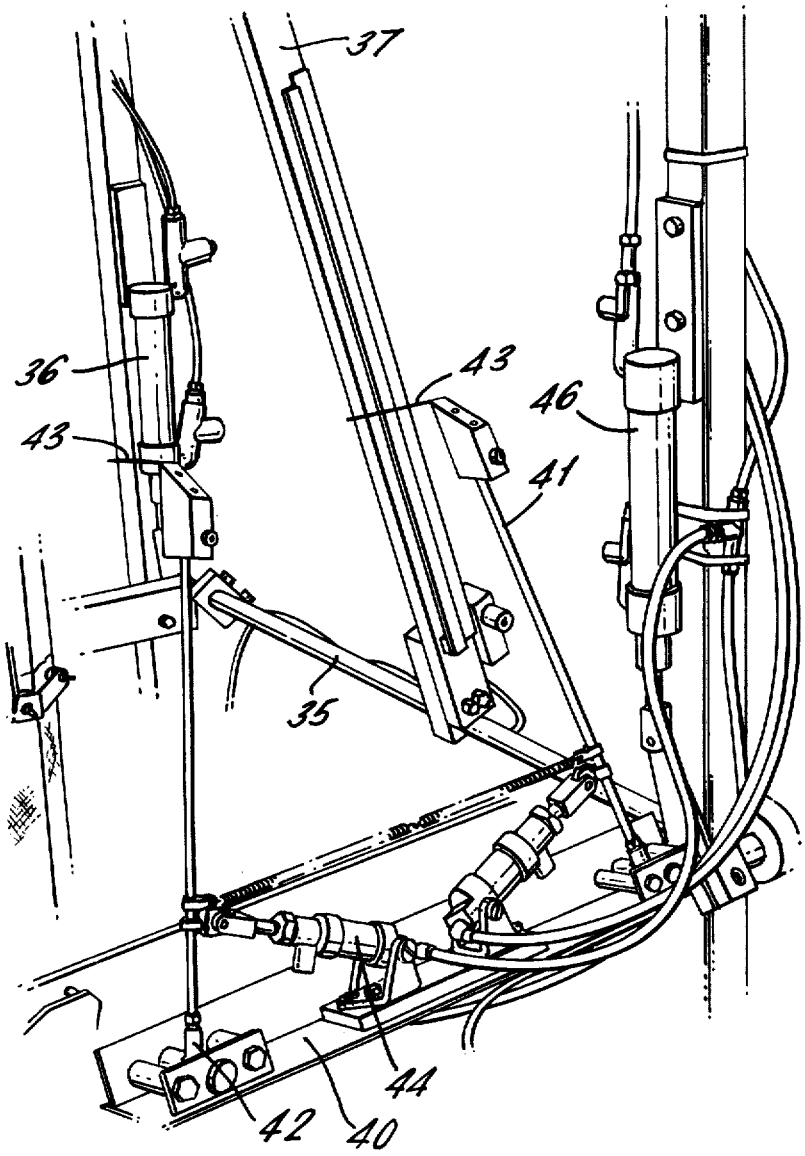
FIGS. 5 to 7 are views from different angles of the bag closing apparatus of FIG. 1.
Figure 6:
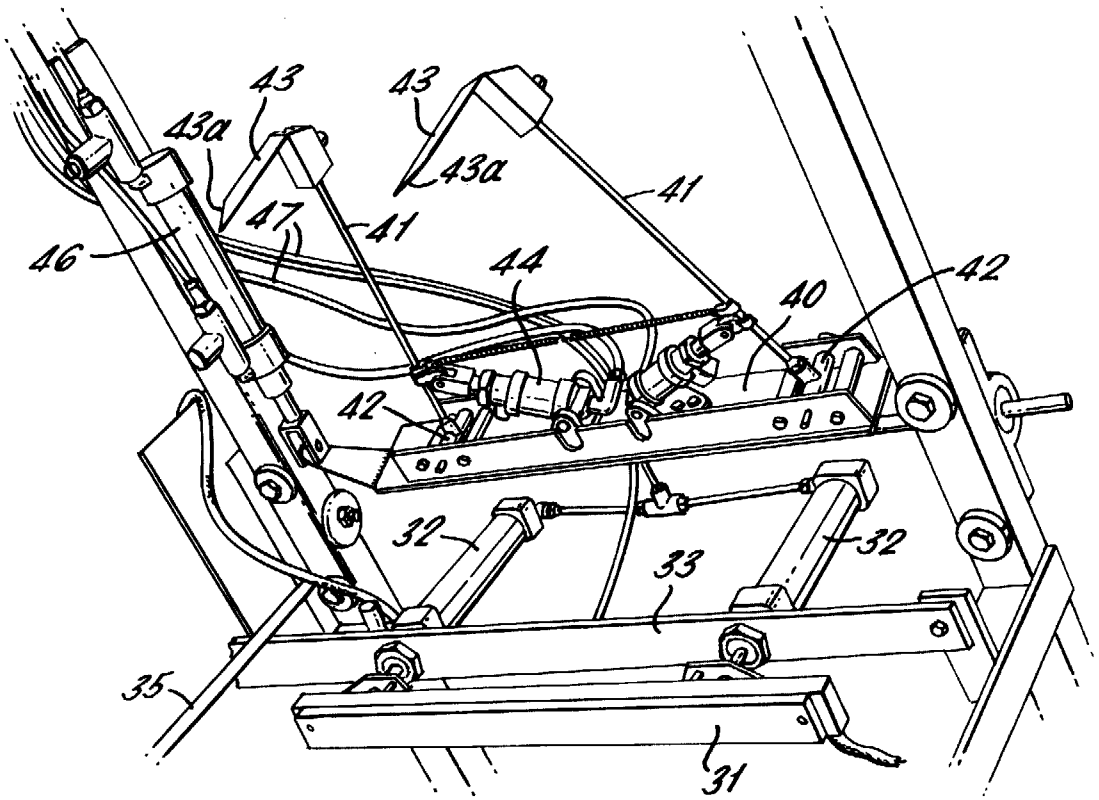
Figure 7:
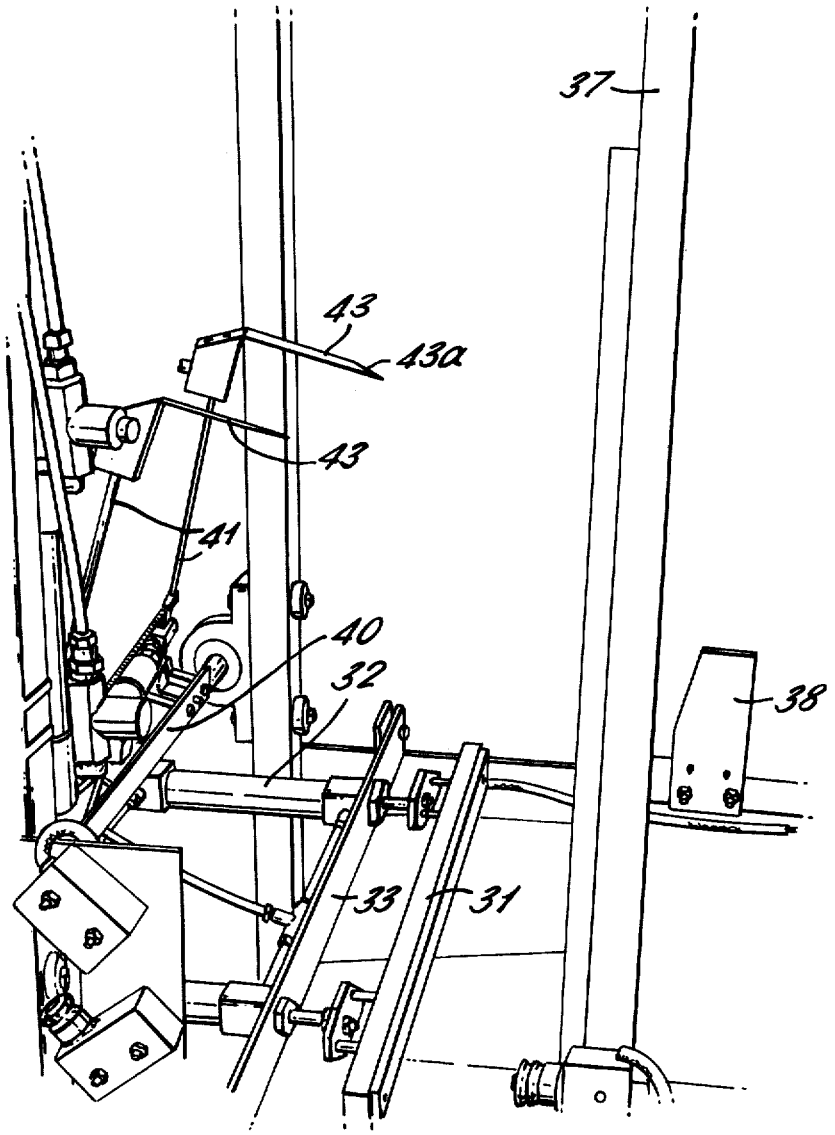

In use the apparatus 10 is initially switched on. The initial switching on of the apparatus 10 causes potatoes to be supplied to the weighing apparatus of the weighing machine 11 and for pneumatic rams 23 to be pressurised along its respective air line 47 by system 48 to drive the chute 26 into the open bag 18, which has been blown open by nozzle 19. The chute 26 is guided into the bag by means of guide rod 22. As the chute 26 reaches its lowermost position, defined by the movement available to ram 23, in which its tip is fully inserted into bag 18 a valve (not shown) is operated by means (not shown) which causes air to be supplied along line 47 to the clamp 28 rotating the clamp 28 so that it traps the bag between itself and the chute 26. This clamping is clearly shown in FIG. 4.

When the weighing apparatus of the weighing machine 11 contains the required weight of potatoes it releases them down hopper 50 onto conveyor 12, which streams out the potatoes and delivers them via output 17 into chute 26 through its open side. The chute 26 guides the potatoes into the bag 18, into which it is inserted. This is the stage which has been reached in FIG. 4.

After a built-in (but adjustable) time delay which is set to allow time for the potatoes previously weighed and delivered to chute 26 has elapsed, pneumatic ram 29 is activated by means of system 48 and its air line 47 to drive the trolley 21 from right to left along its guideway (as viewed in FIG. 1) and hence drive the chute and the filled bag 18 attached thereto towards the bag closure station 14. The pneumatic ram 29 is arranged such that the bag 18 and chute 26 are stopped by the anvil 37. The movement of the trolley 21, frame 24 and chute 26 to this position activates a microswitch, (not shown) which causes system 48 to supply air along the air line 47 of pneumatic rams 46, which rotates rod 39 in a clockwise direction, sweeping fingers 43 down the sides of chute 26 into the bag 18 supported by the chute 26. Preferably the chute 26 is provided with guide elements to help direct the free ends of fingers 43 into the bag 18.

The rotational movement of frame 42 activates a further microswitch (not shown) which causes system 48 to supply air on lines 47 of pneumatic rams 44, which push the arms 41 outwardly, away from each other, causing the outer edges of fingers 43 to engage the bag and to draw the top of the bag 18 into the configuration shown in FIG. 13. The activation of rams 44 causes a further microswitch (not shown) to be switched releasing the air pressure on line 47 of pneumatic ram 23, and thus raising the chute 26. The clamp 28 is simultaneously released, so that as the finger elements 43 move outwardly and take support of the upper part bag 18 the support of the chute 26 is removed.

Once the chute 26 has reached its fully raised position the trolley 21 is drawn back into the position shown in FIG. 1 and the chute 26 is lowered into the next awaiting open bag 18. Each of these movements is controlled by microswitches, not shown, which detects the end of one movement before the succeeding movement is initiated.

Figure 3:
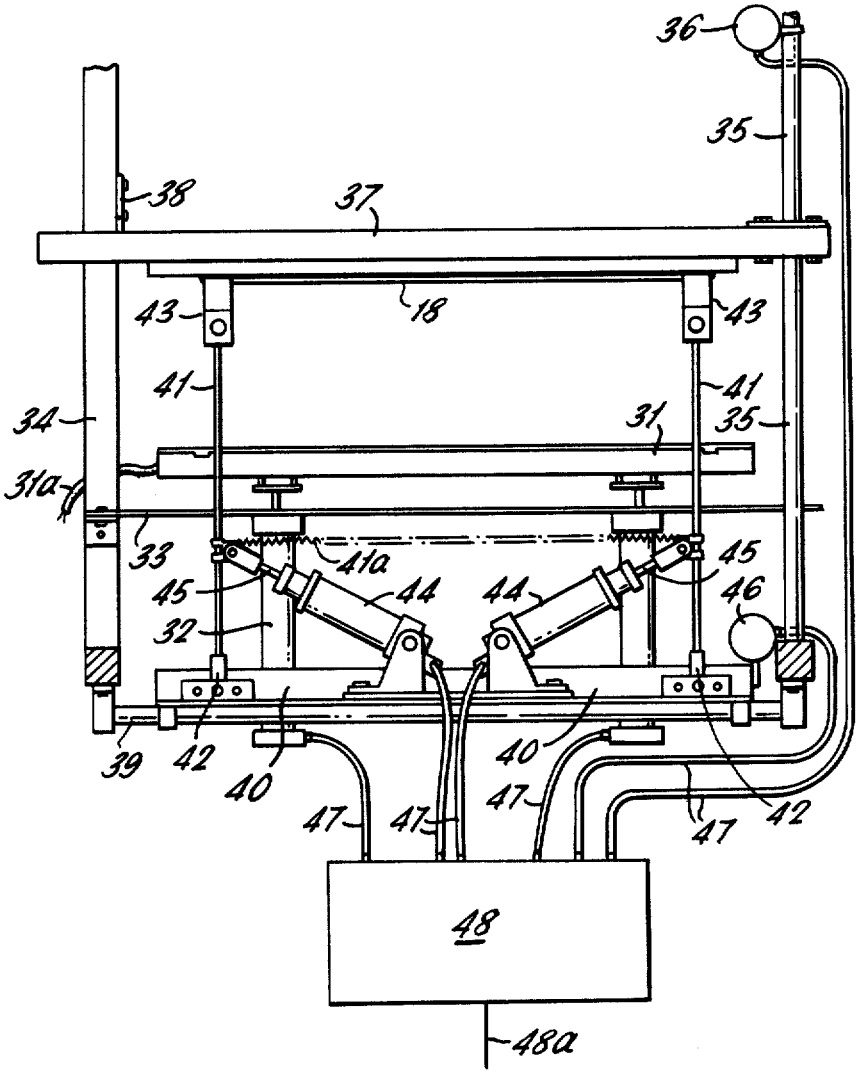
FIG. 3 is a view from above of the bag closing apparatus of FIG. 1, in which some of the elements are shown in the positions that they take up later in the sequence of operation of the apparatus of FIG. 1 as compared with the position shown in FIG. 1.

The detection of the return movement of the chute 26 past the anvil to the filling position by a microswitch (not shown) also causes sytem 48 to supply air on the line 47 connected to pneumatic ram 36, which rotates rod 35 and hence lowers anvil 37 into its lowered position shown in FIG. 3.

The lowering of anvil 37 into this position activates a further microswitch which causes pneumatic rams 32 to be activated by system 48 and hence the heating element is driven into engagement with the anvil 37 to heat seal or weld the sides of the mouth of the bag 18 together between the fingers 23. A first time delay device is operated to hold the heating element 31 under pressure against the anvil with the bag mouth trapped therebetween and a second time delay device energises the heating element for a lesser time so that the pressure is maintained at the seal after the heating element is switched off. Both time delay devices are adjustable. At the end of pressure delay, the system 48 causes rams 32 to withdraw heating element 31, ram 36 to raise anvil 37, ram 46 to rotate rod 39 and hence withdraw fingers 43 from the sealed bag 18 and rams 44 to allow spring 41*a* to return arms 41 into the position shown in FIG. 2. Return of the chute to the filling position causes a microswitch operating ram 23 to operate to lower the chute into the next awaiting bag as described earlier.

As described above wicketed bags 18 normally have one side that is the side attached to the wicket, longer than the other. In normal heat sealing operations the seal leaves a flap comprising the extra length of one side. This has to be trimmed off and the trimmed portions are extremely difficult to remove away from the apparatus. In the above described apparatus the downward movement of the anvil 37 catches the extra portion of the wicketed bag and folds it back on itself, so that when the bag is heat sealed the extra portion is sealed in its turned over position. If desired a fan or blower 9 can be positioned to blow between the fingers 43 to turn this extra portion to ensure that the anvil 37 wipes the extra portion completely over into its turned over position. Alternatively the blower alone may be used.

The fingers 43 are dimensioned so that they extend into the bag 18 beneath the level of the anvil 37 and heating element 31 so that the sealed portion of the bag is held fully in tension. This provides a greatly superior seal to that provided by conventional heat sealing mechanisms where the bag is tensioned at a point away from the sealed area, during sealing.

In a further modification of the above system the ram 46 for raising the fingers 43 out of the bag may be triggered to operate when the heating element 31 is first pressed against the anvil 35 but before pressure is fully applied leaving the mouth of the bag supported only by the heating element and anvil. The heat seal subsequently formed is not then interrupted by the fingers 43 and therefore extends across the entire mouth of the bag fully sealing the bag mouth.

Further, a ram operated pusher may be provided for discharging filled sealed bags from the apparatus laterally of the sealing station after the sealing operation has been completed and the heating element been retracted and the anvil raised.

The outer edges of the fingers 43 which engage in the mouths of the bags may also be modified by the provision of one or more V-shaped projections on the edges of the fingers to assist in gripping the mouth of the bag.

We claim:

1. A bag filling and closure apparatus, comprising
- a filing station including means for opening a mouth of a bag in said filling station;
- a supply chute including
  - means for raising and lowering said chute into and out of the mouth of the bag to be filled,
  - means for clamping the bag mouth to the chute, and means for moving said chute to and from said filing station; and
- a bag sealing station including
  - a pair of mouth tensioning elements,
  - first means for moving said elements into and out of the bag mouth supported by said chute,
  - second means for moving said elements apart to support the bag mouth as said means for clamping the bag mouth are released and as said chute is withdrawn from the bag mouth and returned to said filling station,
  - elongated heat sealing means for engaging and sealing sides of the bag mouth together, and
  - control means for controlling said heat sealing means and said tensioning elements such that said elongated heat sealing means engage and clamp portions of the bag mouth sides lying between said tensioning elements together for partial welding while said tensioning elements are in the bag mouth.

2. A bag filling and closure apparatus according to claim 1 wherein said control means cause said heat sealing means to engage the bag mouth sides with a first pressure sufficient to support the bag mouth therebetween, then triggers said first means to extract said tensioning elements from the bag mouth, and then causes said heat sealing means to engage the bag mouth with a second, higher pressure to completely weld the bag mouth.

3. A bag filling and closure apparatus according to claim 1 wherein said elongated heat sealing means comprise an elongated heating element, an elongated anvil and means for forcing said heating element and said anvil together to heat seal the bag mouth therebetween.

4. A bag filling and closure apparatus according to claim 3 wherein said elongated anvil is mounted at one end on a rotatable shaft; and means are provided for pivoting said anvil into and out of alignment with said heating element to perform a heat sealing operation and to allow the bag mouth to be moved into position for the heat sealing operation, respectively.

5. A bag filling and closure apparatus according to claim 4 wherein said means for forcing comprises ram means for forcing said heating element into engagement with said anvil to apply pressure to the bag mouth being heated sealed; and means are provided for supporting said anvil in alignment with said heating element and for withstanding pressure applied on said anvil by said heating element.

6. A bag filling and closure apparatus according to claim 1 wherein said pair of tensioning elements are mounted on a pair of arms pivotally mounted on a base; said second means comprise ram means for forcing said arms apart to tension the bag mouth and spring means for drawing said arms together to release the tension when said ram means are deactivated; and said first means comprise means for lowering and raising said arms to insert and withdraw said tensioning elements into and from the bag mouth.

7. A bag filling and closure apparatus according to claim 6 wherein said means for raising and lowering said arms comprise a carrier, on which said arms are mounted, rotatably mounted about a horizontal axis, and rams means for rotating said carrier about said horizontal axis.

8. A bag filling and closure apparatus according to claim 1 wherein said tensioning elements comprise a pair of flat blades lying in a common plane and movable towards and away from each other in said plane.

9. A bag filling and closure apparatus according to claim 1 wherein means are provided for holding a supply of bags attached by one side of the mouth of each bag only; and means are provided for blowing down into the mouth of an end bag of said supply of bags to open the mouth of the end bag.

10. A bag filling and closure apparatus according to claim 1 wherein the bag mouth to be heat sealed has, on one side, an upstanding flap; and means are provided for directing an air jet against said flap to turn said flap downwardly and to trap said flap between said heat sealing means during a heat sealing operation of the bag mouth.

11. A bag filling and closure apparatus according to claim 10 wherein means are provided, on said heat sealing means, for folding the upstanding flap downwardly before said heat sealing means engage the bag mouth to heat seal the flap and the bag mouth together.

* * * * *